US005317953A

United States Patent [19]

Wentworth

[11] Patent Number: 5,317,953

[45] Date of Patent: Jun. 7, 1994

[54] NEUTRAL-CENTERING VALVE CONTROL SYSTEM

[75] Inventor: Steven W. Wentworth, Greenfield, Wis.

[73] Assignee: Earth Tool Corporation, Oconomowoc, Wis.

[21] Appl. No.: 888,200

[22] Filed: May 26, 1992

[51] Int. Cl.[5] ..... F15B 13/04

[52] U.S. Cl. ..... 91/466; 91/434; 91/465; 137/596; 137/625.69

[58] Field of Search ..... 91/434, 465, 466; 137/596, 625.69

[56] References Cited

U.S. PATENT DOCUMENTS

| | | | |
|---|---|---|---|
| 2,140,037 | 12/1938 | Swisher | 91/434 X |
| 2,617,257 | 11/1952 | Douglas | 137/625.69 X |
| 2,824,447 | 2/1958 | Garrison | 91/372 X |
| 2,919,681 | 1/1960 | Schultz | 137/625.69 |
| 3,099,289 | 7/1963 | Neilson et al. | 137/596 X |
| 3,312,246 | 4/1967 | Tam | 137/625.69 |
| 3,472,264 | 10/1969 | Petry . | |
| 3,581,771 | 6/1971 | Garrison et al. | 137/625.69 |
| 3,630,234 | 12/1971 | Hoffman . | |
| 3,636,978 | 1/1972 | Byers . | |
| 3,954,149 | 5/1976 | Strauff | 91/465 X |
| 4,123,964 | 11/1978 | Strauff | 91/434 |
| 4,134,418 | 1/1979 | Woodcock . | |
| 4,201,116 | 5/1980 | Martin . | |
| 4,338,965 | 7/1982 | Garnjost et al. . | |
| 4,456,031 | 6/1984 | Taplin . | |
| 4,537,220 | 8/1985 | Anderson . | |
| 4,606,369 | 8/1986 | McKay . | |

OTHER PUBLICATIONS

Electrohydraulic Valves and Servosystems, pp. 95–96, (undated).

*Primary Examiner*—Gerald A. Michalsky
*Attorney, Agent, or Firm*—Foley & Lardner

[57] ABSTRACT

A valve control system for controlling the operation of a pressure fluid-activated device such as a hydraulic cylinder includes a valve housing having an internal, sealed valve chamber therein. A valve spool is slidably disposed for lengthwise movement within the valve chamber, the valve spool having a valve member for selectively admitting a pressure fluid through passages in the vale housing. A movable handle for manual operation of the valve is connected to the valve spool by a connecting mechanism, whereby movement of the handle causes lengthwise movement of the valve spool relative to the valve housing. A neutral-centering tactile feedback mechanism applies a return force to the handle when the handle is in an operative position. The return force varies in proportion to the pressure of the pressure fluid within the valve, which pressure actuates the device. The feedback mechanism ceases to apply the return force when the handle returns to a neutral position. The load, however, remains pressurized, permitting an arm or tool operated by a suitable device, such as a hydraulic cylinder, to remain in position. For example, an excavator arm could remain suspended in mid-air without need for the operator to hold the handle, providing enhanced convenience and safety.

22 Claims, 6 Drawing Sheets

NEUTRAL-CENTERING VALVE CONTROL SYSTEM

TECHNICAL FIELD

This invention relates to valve control systems, particularly to manually-operated hydraulic valves.

BACKGROUND OF THE INVENTION

Hydraulic valves are used in a variety of applications, such as the control of hydraulic cylinders. In particular, such valves are an integral part of the control system for hydraulically operated arms of heavy machinery such as backhoes, excavators, and the like. Such a valve generally has an internal valve chamber with ports that allow fluid to flow into and from the internal chamber, for example, a pressure port through which pressurized fluid flows into the valve chamber, one or more load ports through which the pressurized fluid is conducted to a load-moving device such as a hydraulic cylinder, and one or more exhaust ports for depressurizing the valve chamber. A movable valve member within the valve chamber regulates communication between the pressure, load and exhaust ports.

Among hydraulic valves, dual spool or double cylinder valves are well known. See in particular Anderson U.S. Pat. No. 4,537,220, issued Aug. 27, 1985, Hoffman U.S. Pat. No. 3,630,234, issued Dec. 28, 1971, Martin, U.S. Pat. No. 4,201,116, issued May 6, 1980, Taplin U.S. Pat. No. 4,456,031, issued Jun. 16, 1984 and Garnjost et. al. U.S. Pat. No. 4,338,965, issued Jul. 13, 1982.

In many known valves, the valve is actuated manually by a handle, as in Petry U.S. Pat. No. 3,472,264, issued Oct. 16, 1969 and Woodcock U.S. Pat. No. 4,134,418, issued Jan. 16, 1979. Byers U.S. Pat. No. 3,636,978, issued Jan. 25, 1972, and McKay U.S. Pat. No. 4,606,369, issued Aug. 19, 1986 describe systems wherein the handle provides tactile feedback, i.e., a resistance that provides a feel of the valve pressure to the operator.

Despite the availability of a wide variety of hydraulic valves, control systems utilizing such valves for operating hydraulic digging arms and the like lack a means for allowing the operator to feel, through the handle, a force proportional to the hydraulic pressure. Such a force would warn the operator when an obstruction has been encountered. For example, when excavating near a foundation, the excavator operator normally cannot readily tell whether the digging arm has hit the foundation wall, possibly damaging it. Tactile feedback can prevent such accidents by allowing the operator to feel the sudden increase in pressure when the obstruction is encountered. Tactile feedback in the form of a variable resistance control handle, however, would create a problem in situations where the operator might want to lift and hold a load without forcefully holding down the control handle. The present invention addresses this problem by providing a neutral-centering valve construction suitable for control of hydraulic-cylinder operated devices.

SUMMARY OF THE INVENTION

A valve control system according to the invention for controlling the operation of a pressure fluid-activated device such as a hydraulic cylinder includes a valve housing having an internal, sealed valve chamber therein. A valve spool is slidably disposed for lengthwise movement within the valve chamber. The valve spool has a valve surface for selectively admitting a pressure fluid through the valve chamber via passages in the valve housing. A movable handle for manual operation of the valve is connected to the valve spool by a connecting mechanism, whereby movement of the handle causes lengthwise movement of the valve spool relative to the valve housing. A neutral-centering tactile feedback mechanism applies a return force to the handle when the handle is in an operative (load) position. The return force varies in proportion to the pressure of the pressure fluid within the valve, which pressure actuates the device. The feedback mechanism ceases to apply the return force when the handle returns to a neutral position at which pressure to the device is still maintained.

According to one aspect of the invention, the valve chamber has a first bearing, a load port in communication with the valve chamber for conducting pressure fluid to the load, an exhaust port in communication with the valve chamber for relieving pressure within the valve chamber, the exhaust and pressure ports being disposed on opposite sides of the first bearing, a second bearing spaced from the first bearing, and a pressure port in communication with the valve chamber for supplying pressurized fluid to the valve chamber, the pressure and load ports being disposed on opposite sides of the second bearing. The control valve also includes a sealed response piston chamber isolated from the valve chamber and having a feedback port which provides communication between the load port and response piston chamber. The valve spool has at least one valve surface disposed for sliding, sealing engagement with the first and second bearings of the valve chamber between a load position in which the pressure port and load port are in communication with each other, an exhaust position in which the load port and the exhaust port are in communication with each other, and the neutral position in which the load port is isolated from both of the pressure and exhaust ports.

A response piston is slidably mounted within the response piston chamber. Movement of the valve spool to the load position in response to movement of the handle causes fluid from the pressure port to flow to the load port and through the feedback port to the response piston chamber, whereby the response piston exerts a force against the valve spool which urges the valve spool back towards the neutral position. In the neutral position, the load port is isolated from both the exhaust and pressure ports, and the response piston is configured so that it no longer exerts force against the spool. The load, however, remains pressurized, permitting an arm or tool operated by a suitable device, such as a hydraulic cylinder, to remain in position. For example, an excavator arm could remain suspended in mid-air without need for the operator to hold the handle, providing enhanced convenience and safety.

BRIEF DESCRIPTION OF THE DRAWINGS

The invention will be described with reference to the accompanying drawings, wherein like numerals denote like elements, and.

DETAILED DESCRIPTION OF PREFERRED EMBODIMENTS

Figure 1:
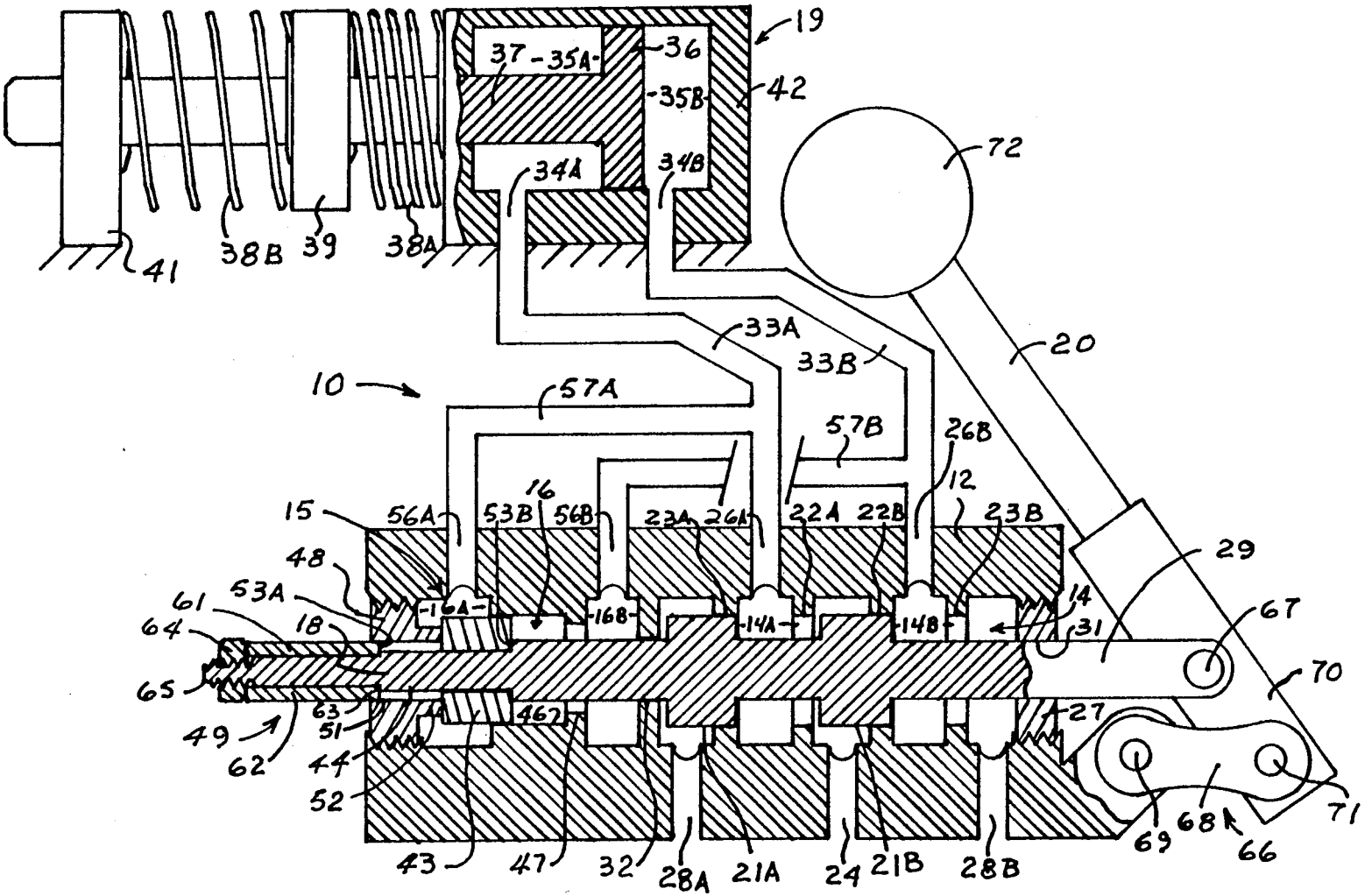
FIG. 1 is a lengthwise sectional view of a first embodiment valve control system according to the invention in a first load position, with hydraulic fluid connections shown schematically.

Referring now to FIG. 1, a valve control system 10 according to the invention includes as main components a valve housing 12, a dual valve chamber 14 disposed within valve housing 12, a feedback mechanism 15 including a response piston chamber 16 also disposed within valve housing 12 and coaxially with valve chamber 14, a valve spool 18 slidably disposed within valve chamber 14 and response piston chamber 16 and extending from each end of valve housing 12, and a handle 20 attached to valve spool 18 for sliding valve spool 18 back and forth within chambers 14, 16 for actuating the load device, a double-acting hydraulic cylinder 19. This embodiment of the invention is double-acting, i.e., provides tactile feedback in either of two positions on opposite sides of the neutral position, as explained in detail hereafter.

Valve chamber 14 is divided into a first valve chamber 14A and a second valve chamber 14B which operate from a common pressure supply as follows. Valve spool 18 has a pair of spaced cylindrical valve members 21A and 21B positioned within chambers 14A, 14B, respectively. Each of valve members 21A, 21B slides into and out of sealing engagement with corresponding first and second cylindrical bearings 22A, 23A and 22B, 23B, respectively. Bearings 22A, 23A and 22B, 23B are preferably annular lands and are spaced from each other in the lengthwise direction of valve spool 18 by a distance less than the length of each respective valve member 21A, 21B, whereby each valve member can slide into sealing engagement with both of the associated bearings at the same time.

Valve housing 12 has a plurality of ports drilled therein for conducting hydraulic pressure fluid to and from chambers 14A, 14B, and 16. A common pressure port 24 opens into both of chambers 14A, 14B at a location between bearings 22A and 22B. A first load port 26A opens into chamber 14A between bearings 22A and 23A, and a second load port 26B similarly opens into chamber 14B between bearings 22B and 23B. A first exhaust port 28A opens onto chamber 14A on the other side of bearing 23A from load port 26A. Similarly, a second exhaust port 28B opens on the far side of bearing 23B.

At the front end of chamber 14, a threaded bearing ring 27 is threadedly secured to valve housing 12. A front end portion 29 of spool 18 is slidably disposed in sealed engagement with a central opening 31 in ring 27 and extends therethrough out of housing 12 for connection with handle 20. At the rear end of chamber 14, a bearing land 32 is in sealing engagement with a mid-portion of spool 18, isolating chamber 14 from response piston chamber 16.

Load ports 26A and 26B are connected via a combination of passages, hoses and/or other suitable conduits 33A, 33B to pressure fluid ports 34A, 34B of hydraulic cylinder 19. Pressure port 24 is similarly connected to a supply of pressurized hydraulic fluid, and exhaust ports 28A, 28B are connected to an exhaust tank.

Ports 34A, 34B open on opposite sides of a movable piston head 36 into forward and rearward stroke chambers 35A, 35B, respectively, of cylinder 19. Piston head 36 is connected to a piston rod 37 which transmits force to any suitable tool or similar device, not shown, such as a hinged arm, loader bucket, or the like in a manner well known in the art. A pair of springs 38A, 38B disposed on opposite sides of a radial stop 39 on rod 37 bias piston head 36 to a rest position about midway between pressure fluid ports 34A, 34B. Springs 38A, 38B are confined for compression at the ends thereof remote from stop 39 by a second stop 41 and by housing 42 of cylinder 19.

Like valve chamber 14, response piston chamber 16 is divided into a first, variable volume response piston chamber 16A and a second, variable volume response piston chamber 16B. A tubular response piston 43 is slidably, sealingly mounted with its inner surface on a reduced diameter portion 44 of spool 18 and with its outer surface on a cylindrical portion 46 of chamber 16B. Chamber 16B further includes a radial stop 47 which limits travel of the response piston 43 to a forwardmost position. At the rear end of chamber 16A, a threaded bearing ring 48 is threadedly secured to valve housing 12. A rear end portion 49 of spool 18 is slidably disposed in sealed engagement with a central opening 51 in ring 48 and extends therethrough out of housing 12. Ring 48 has a forwardly extending annular stop 52 which limits travel of the response piston 43 to a rearwardmost position. When handle 20 is moved to its endmost position as shown in FIG. 1, piston 43 is clamped between stop 52 and a shoulder 53B at the front end of reduced diameter portion 44 of spool 18.

A first feedback pressure port 56A opens into response piston chamber 16A at a position rearwardly of cylindrical portion 46 so that pressurization of chamber 16A will push response piston 43 forwardly. Correspondingly, a second feedback pressure port 56B opens into response piston chamber 16B at a position forwardly of stop 47 so that pressurization of chamber 16B will push response piston 43 rearwardly. A first branch conduit 57A connects port 56A to conduit 33A, whereby pressurization of chamber 14A causes pressurization of chamber 16A. In the same manner, a second branch conduit 57B connects port 56B to conduit 33B, so that pressurization of chamber 14B causes pressurization of chamber 16B.

Rear end portion 49 of valve spool 18 provides a shoulder 53A of greater diameter than reduced diameter portion 44 which engages response piston 43 on the opposite side from shoulder 53B, as explained below in connection with FIG. 3. In the illustrated embodiment, shoulder 53A is the rear end of a tubular sleeve 61 mounted on a second reduced diameter portion 62 of spool 18, portion 62 having a smaller diameter than the adjoining portion 44, so that a step 63 is defined therebetween. Sleeve 61 is removably secured against step 63 by any suitable means, such as a nut 64 threadedly coupled with a threaded end portion 65 of spool 18, or any similar mechanical fastener. The outside of sleeve 61 is in sliding, sealing engagement with opening 51 in ring 48, and has sufficient length so that response piston chamber 16 remains sealed when handle 20 is in the extreme position shown in FIG. 1.

Handle 20 is connected to valve spool 18 by a mechanical linkage 66 so that linear movement of handle 20 translates directly into lengthwise forward or backward movement of valve spool 18 within housing 12. Linkage 66 includes a pin 67 uniting a lower end portion 70 of handle 20 to the end of front end portion 29 of spool 18, whereby handle 20 can pivot relative to spool 18, and a rigid link 68 pivotally connected by respective pins 69, 71 to housing 12 and lower end portion 70 just below pin 67. Handle 20 which may comprise an elongated rod as shown, thereby pivots around pin 67 and, at the same time, the upper end of handle 20, which may have a knob 72 or similar gripping member, moves towards or away from housing 12.

Figure 2:
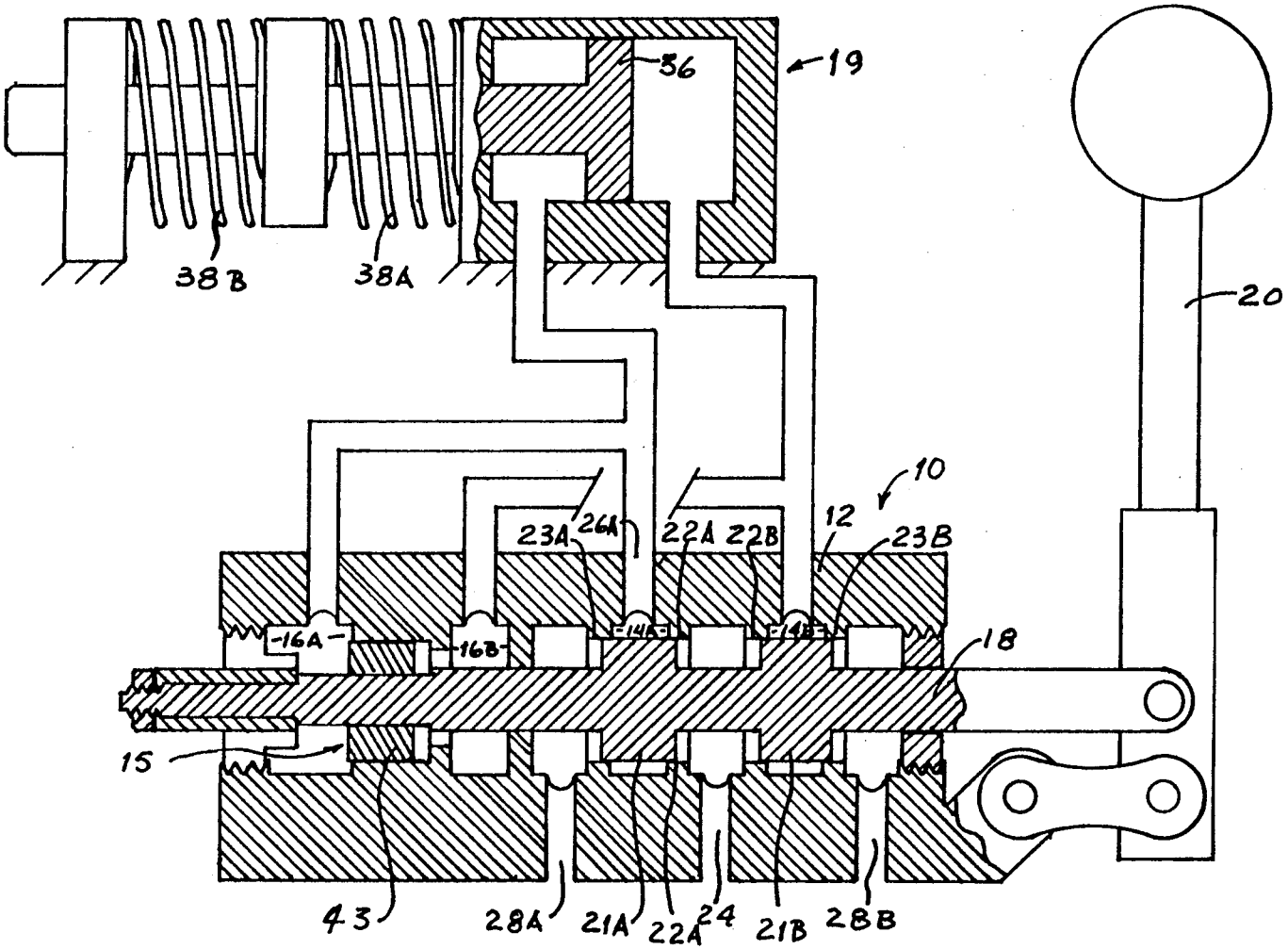
FIG. 2 is a lengthwise sectional view of the valve control system of FIG. 1 in a neutral position.
Figure 3:
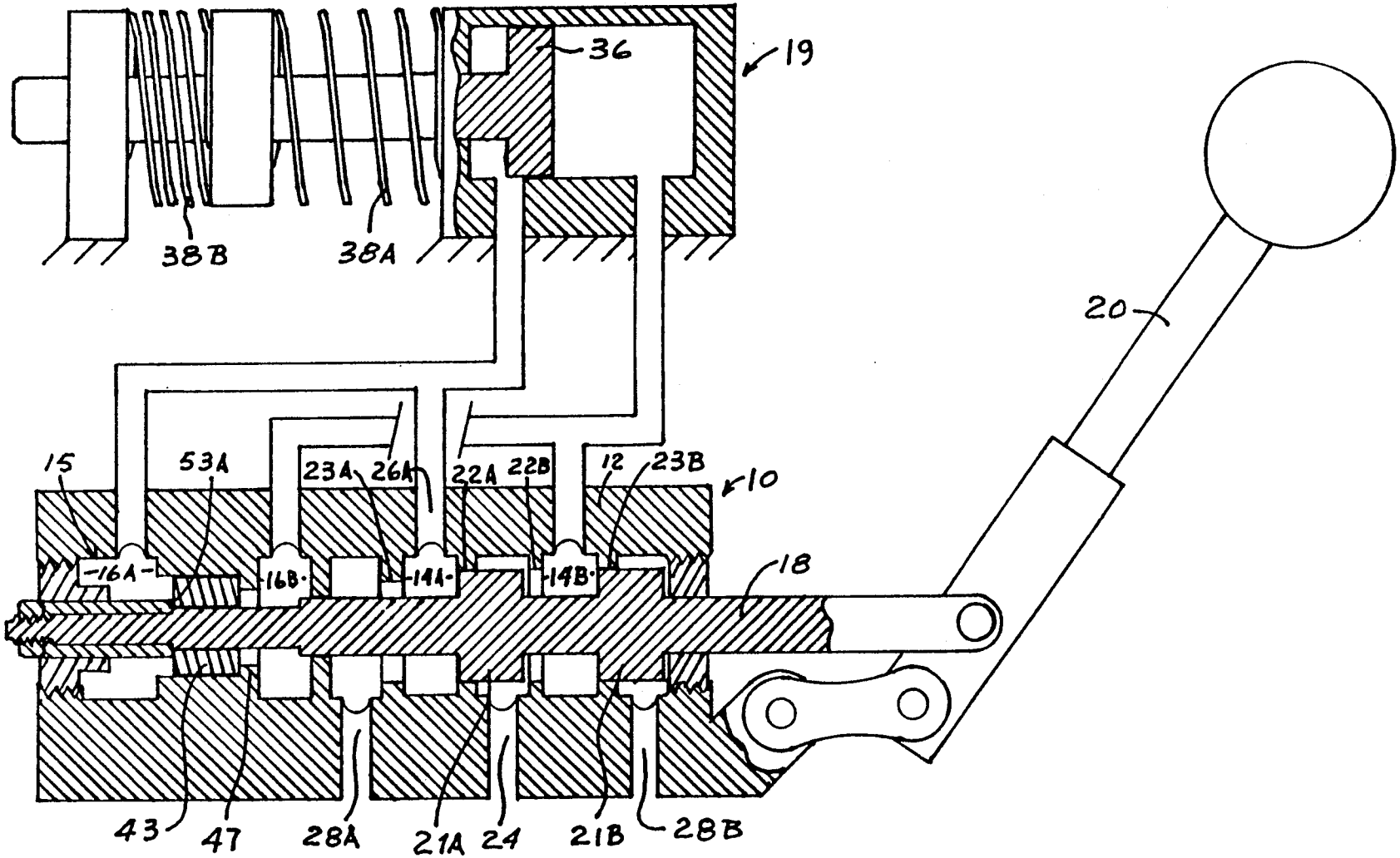
FIG. 3 is a lengthwise sectional view of the valve control system FIG. 1 in a second load position.

A valve control system as shown in FIGS. 1 to 3 operates as follows. As handle 20 moves toward the position shown in FIG. 1, valve members 21A and 21B withdraw from contact with bearings 22A, 23B and remain in sealing contact with bearings 23A, 22B. As a result, pressure port 24 communicates with load port 26A, pressurizing chambers 35A and 16A via conduits 33A, 57A and ports 34A, 56A. Load port 26B communicates with exhaust port 28B, depressurizing chambers 35B and 16B via conduits 33B, 57B and ports 34B, 56B. Contact between valve member 21A and bearing 23A isolates exhaust port 28A, and contact between valve member 21B and bearing 22B isolates load port 26B from pressure port 24.

In this condition, pressurization of chamber 35A forces piston head 36 to the right (in FIG. 1) and compresses spring 38A as shown. At the same time, pressure in chamber 16A acts against the rear surface of response piston 43. Piston 43 engages shoulder 53B and thereby exerts a forwardly directed force against valve spool 18. This force is transmitted to handle 20 by linkage 66, and by this means the operator feels the pressure within the pressurized chambers of the system. Since the rear surface area of response piston 43 is much smaller than the corresponding surface of piston head 36, the tactile feedback force is proportional to but less than the force being exerted by cylinder 19. In the event that the force within chamber 35A suddenly increases, the operator feels a similar increase. If the increase is great, it may cause handle 20 to snap back to the neutral position shown in FIG. 2.

When handle 20 assumes the position shown in FIG. 2, valve members 21A and 21B contact all of bearings 22A, 22B and 23A, 23B. Pressure port 24 is isolated from both of load ports 26A, 26B, and load ports 26A, 26B are similarly isolated from exhaust ports 28A, 28B. Assuming that handle 20 has moved from the position shown in FIG. 1 to the position shown in FIG. 2, chambers 35A and 16A remain pressurized. Chambers 35B and 16B, still filled with hydraulic fluid, no longer communicate with the exhaust tank. Response piston 43 and piston head 36 move to equilibrium positions at which the pressure on both sides of piston head 36 and response piston 43 becomes equalized, as shown in FIG. 2. In this manner, the present invention provides a valve control system which provides for a neutral center position. Springs 38A, 38B help ensure that handle 20 is biased to the neutral position from both directions.

In FIG. 3, the control valve assumes a condition opposite to that shown in FIG. 1. Valve members 21A and 21B withdraw from contact with bearings 23A, 22B and remain in sealing contact with bearings 22A, 23B. As a result, pressure port 24 communicates with load port 26B, pressurizing chambers 35B and 16B. Load port 26A communicates with exhaust port 28A, depressurizing chambers 35A and 16A. Contact between valve member 21B and bearing 23B isolates exhaust port 28B, and contact between valve member 21A and bearing 22A isolates load port 26A from pressure port 24.

Pressurization of chamber 35B forces piston head 36 to the left and compresses spring 38B as shown. At the same time, pressure in chamber 16B acts against the front surface of response piston 43. Piston 43 engages shoulder 53A and thereby exerts a rearwardly directed force against valve spool 18. Again the operator feels the pressure within the pressurized chambers of the system, but in the opposite direction. Like the rear surface, the front surface area of response piston 43 is much smaller than the corresponding surface of piston head 36, so that the tactile feedback force is proportional to but less than the force being exerted by cylinder 19. When handle 20 pivots to its endmost position as shown in FIG. 3, response piston 43 becomes clamped between stop 47 and shoulder 53A. When handle 20 returns from the position shown in FIG. 3 to the neutral position shown in FIG. 2, response piston 43 and piston head 36 again move to equilibrium positions at which the pressure on both sides of piston head 36 and response piston 43 becomes equalized.

The embodiment shown in FIGS. 1-3 provides a compact valve structure which provides 2-way valve action with tactile feedback, and a self-centering neutral position. This embodiment employs only a single valve spool and single response piston, thereby minimizing the number of moving parts.

Figure 4:
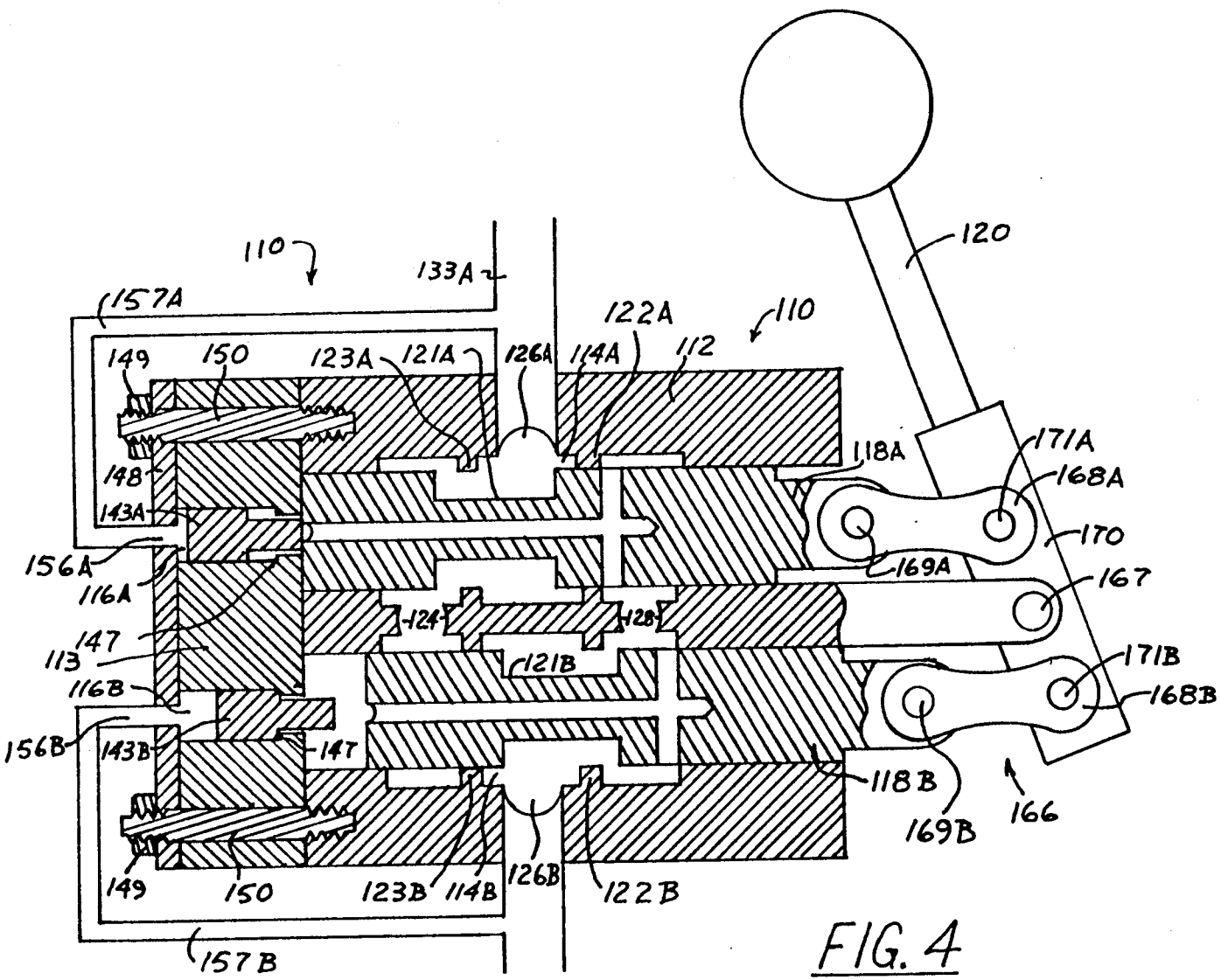
FIG. 4 is a lengthwise sectional view similar to FIG. 1 of an alternate embodiment of a valve control system according to the invention in a first load position.
Figure 5:
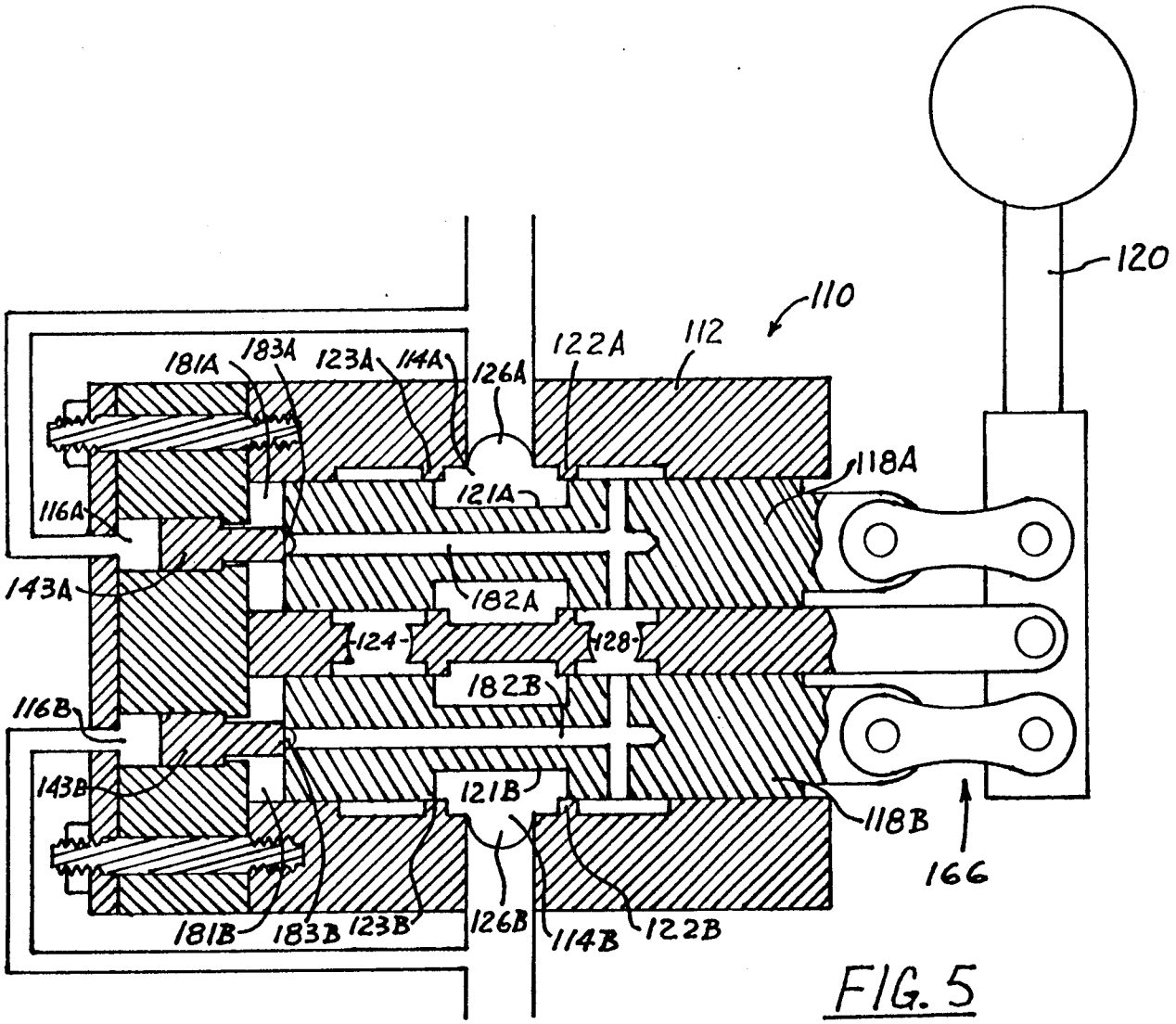
FIG. 5 is a lengthwise sectional view of the valve control system of FIG. 4 in a neutral position.
Figure 6:
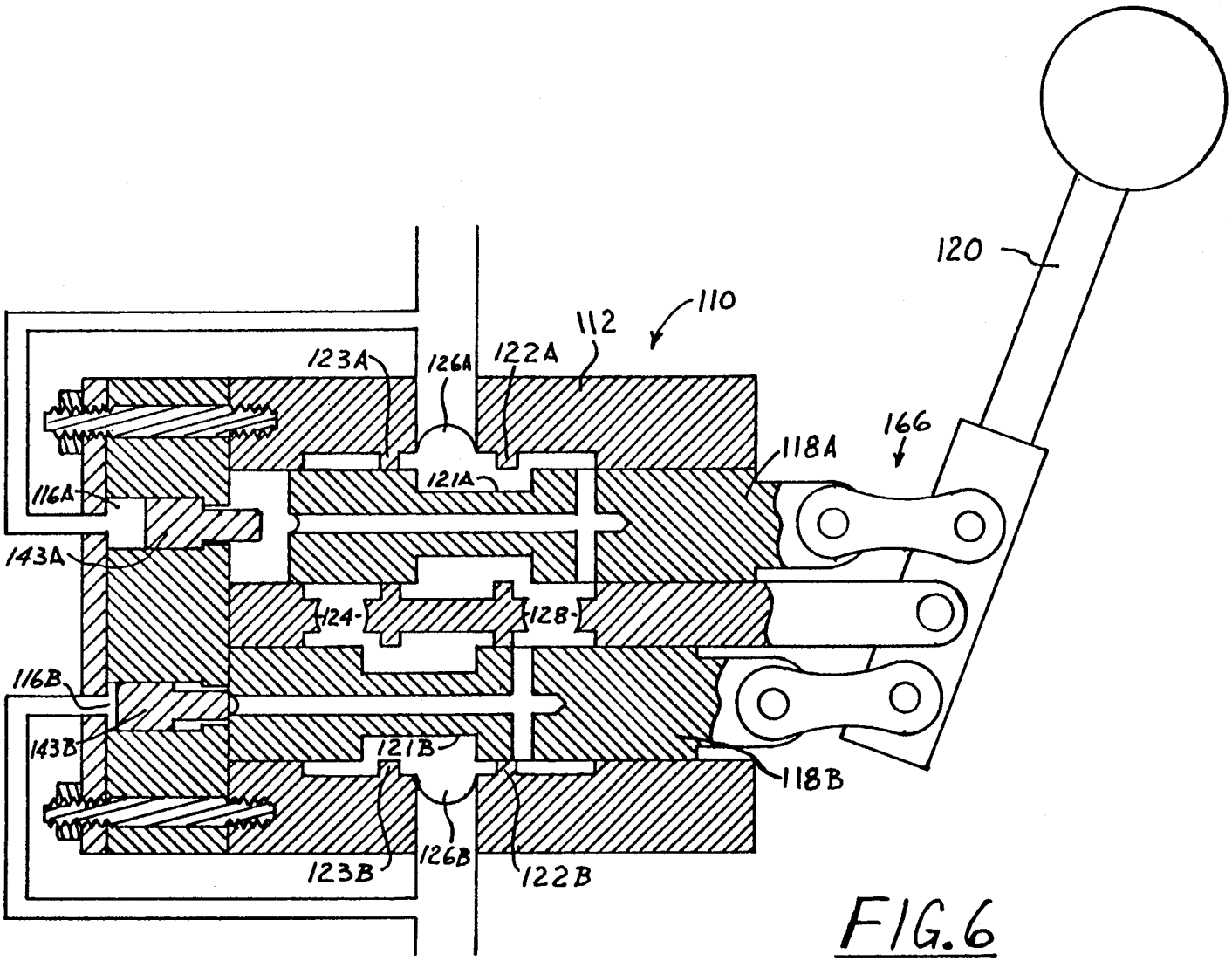
FIG. 6 is a lengthwise sectional view of the valve control system of FIG. 4 in a second load position.

FIGS. 4 to 6 illustrate an alternative embodiment of the invention which works on the same principle as the embodiment of FIGS. 1-3, except that a pair of separate, one-way valve spools and response pistons replace the double-acting spool and response piston of FIGS. 1-3. A valve control system 110 as shown in FIG. 4 includes a valve housing 112, separate valve chambers 114A and 114B disposed side-by-side within valve housing 112, separate response piston chambers 116A and 116B also disposed side-by-side within housing 112 and coaxially with valve chambers 114A and 114B, respectively, a pair of valve spools 118A and 118B slidably disposed within respective valve chambers 114A, 114B and extending from the front end of valve housing 112, and a handle 120 attached to valve spools 118A, 118B for moving the latter back and forth within chambers 114A, 114B, 116A, and 116B to actuate the load device, such as the double-acting hydraulic cylinder 19 of FIGS. 1-3.

Like valve chambers 14A and 14B, valve chambers 114A and 114B operate from a common pressure fluid supply. Valve spool 118A has an annular recess 121A positioned within chamber 114A. The surfaces of valve spool 118A adjacent to recess 121A at either end thereof slide into and out of sealing engagement with corresponding first and second cylindrical bearings 122A and 123A. Bearings 122A, 123A are preferably annular lands and are spaced from each other in the lengthwise direction of valve spool 118A by a distance less than the length of recess 121A. Second spool 118B and chamber 114B are configured in the same manner with a recess 121B and bearings 122B, 123B.

A common pressure port 124 opens onto both of chambers 114A, 114B at a location on the opposite side of bearings 123A, 123B from bearings 122A, 122B. A first load port 126A opens onto chamber 114A between bearings 122A and 123A, and a second load port 126B similarly opens into chamber 114B between bearings 122B and 123B. Load ports 126A and 126B are connected by a combination of passages, hoses and/or other suitable conduits 133A, 133B to pressure fluid ports of the load device. A common exhaust port 128 opens onto each of chambers 114A, 114B at a location on the opposite side of bearings 122A, 122B from bearings 123A, 123B, so that pressure port 124 and exhaust port 128 are symmetrically positioned.

Each of cylindrical response pistons 143A, 143B is slidably, sealingly mounted in each of response piston chambers 116A, 116B. Chambers 116A, 116B each include a radial stop 147 which limits travel of each of response pistons 143A, 143B to a forwardmost position. A reduced diameter front end portion of each response piston 143A, 143B extends past stop 147 for contacting the rear end of each spool 118A, 118B. At the rear end of chambers 116A, 116B, a cover plate 148 is secured to valve housing 112 by any suitable means, such as nuts 149 and bolts 150 as shown. Bolts 150 may extend through a removable housing section 113 in which chambers 116A, 116B are formed. When handle 120 is moved to its endmost position as shown in FIG. 4, the inner end of valve spool 118A abuts an inner wall of housing 112, i.e., the back of section 113.

A first feedback pressure port 156A opens into response piston chamber 116A at its rear end so that pressurization of chamber 116A will push response piston 143A forwardly. Correspondingly, a second feedback pressure port 156B opens at one end of response piston chamber 116B so that pressurization of chamber 116B will push response piston 143B forwardly. A first branch conduit 157A connects port 156A to conduit 133A, so that pressurization of chamber 114A causes pressurization of chamber 116A. In the same manner, a second branch conduit 157B connects port 156B to conduit 133B, so that pressurization of chamber 114B causes pressurization of chamber 116B.

Handle 120 is connected to each of valve spools 118A, 118B by a mechanical linkage 166 so that pivotal movement of handle 20 translates directly into lengthwise forward movement of one valve spool with simultaneous backward movement of the other spool. Linkage 166 suitably includes a pin 167 uniting a lower end portion 170 of handle 120 to housing 112, whereby handle 120 pivots relative to housing 112. A pair of rigid links 168A, 168B are pivotally connected by respective pins 169A, 171A and 169B, 171B to externally projecting ends of valve spools 118A and 118B and to lower portion 170 on opposite sides of pin 167.

The valve control system of FIGS. 4 to 6 operates as follows. When handle 120 assumes the position shown in FIG. 4, recess 121A overlies bearing 123A, and the outer periphery of spool 118A is in sealing contact with bearing 122A. Correspondingly, recess 121B overlies bearing 122B, an the outer periphery of spool 118B is in sealing contact with bearing 123B. As a result, pressure port 124 communicates with load port 126A, pressurizing chamber 116A via conduits 133A, 157A and ports 134A, 156A. Load port 126B communicates with exhaust port 128, depressurizing chamber 116B via conduits 133B, 157B and ports 134B, 156B. Pressure in chamber 116A acts against the rear surface of response piston 143A. Piston 143A exerts a forwardly directed force directly against the rear end of valve spool 118A, Which force is transmitted to handle 120 by linkage 166.

When handle 120 assumes the position shown in FIG. 5, recesses 121A, 121B bridge respective bearings 122A, 122B and 123A, 123B. Pressure port 124 is thereby isolated from both of load ports 126A, 126B, and load ports 126A, 126B are similarly isolated from exhaust port 128. Assuming that handle 120 has moved from the position shown in FIG. 4 to the position shown in FIG. 5, chamber 116A remains pressurized. On the opposite side of chamber 116A, a variable-volume end chamber 181A becomes larger as spool 118A moves away from chamber 116A. Chamber 181A is constantly connected to exhaust port 128 by an internal passage 181A drilled through spool 118A, and remains filled with hydraulic fluid. Spool 118B has an identical chamber 181B and a passage 182B which remains in communication with exhaust port 128 and hence also with passage 182A.

Since chamber 116A remains pressurized while chamber 181A opposite remains depressurized, response piston 143A moves to its endmost position as shown in FIG. 5. Piston 143B remains at its endmost position from a previous cycle, i.e., when handle 120 was used in the manner shown in FIG. 6. Each passage 182A, 182B includes a respective semicircular groove 183A, 183B in the rear face of each spool. Grooves 183A, 183B maintain communication with chambers 181A, 181B when one or both of pistons 143A, 143B engage their respective spools and cover the rear openings of passages 182A, 182B. Passages 183A, 183B, 124, 126A, 126B and 128 extend out of the plane of the page in FIGS. 4–6.

In FIG. 6, the control valve 110 assumes a condition opposite to that shown in FIG. 4. Recess 121B overlies bearing 123B, and the outer periphery of spool 118B is in sealing contact with bearing 122B. Correspondingly, recess 121A overlies bearing 122A, and the outer periphery of spool 118A is in sealing contact with bearing 123A. As a result, pressure port 124 communicates with load port 126B, pressurizing chamber 116B. Load port 126A communicates with exhaust port 128, depressurizing chamber 116A. Pressure in chamber 116B acts against the rear surface of response piston 143B. Piston 143B exerts a forwardly directed force directly against valve spool 118B, which force is transmitted to handle 120 by linkage 166.

In this mode, response piston 143A remains inactive, while piston 143 exerts the return force to provide tactile feedback to handle 120. In this manner, pistons 143A, 143B act alternately to bias handle 120 towards the neutral position shown in FIG. 5. The embodiment of FIGS. 4–6 thus can accomplish the same objectives as that of FIGS. 1–3.

Tactile feedback as provided by the control valve according to the invention can provide hydraulic machine operators with much greater control over digging operations without need for elaborate sensors or electronics. Neutral centering as provided by the present invention permits the operator to hold a position, e.g. of an excavator arm or bucket, without completely releasing the load. This feature is important to practical lifting, digging, dumping and similar hydraulic arm operations.

It will be understood that the foregoing description is of preferred exemplary embodiments of the invention, and that the invention is not limited to the specific forms shown. For example, a one-way valve control system could be provided with separate positions for load, neutral, and exhaust, without providing a second load port that is pressurized when the first one exhausts. Such an embodiment could be used in conjunction with a one-way hydraulic cylinder that is retracted by a spring or external force. Many minor modifications, such as varying the valve shapes, the arrangement and number of ports, and the like can also be made. Additionally, the invention is not limited to the applications discussed above. The pressure fluid may be compressed air or the like, and the valve may be used in any application where it is desired to provide for manual valve control. These and other modifications may be made in the design and arrangement of the elements without departing from the scope of the invention as expressed in the appended claims.

I claim:

1. A valve control system for controlling operation of a pressure fluid-actuated device, comprising:

a valve housing having a sealed valve chamber therein;

a vale spool slidably disposed for lengthwise movement within the valve chamber, the valve spool having a valve member for selectively admitting a pressure fluid through passages in the valve housing;

a movable handle comprising an elongated rod having a gripping member at one end thereof and a pivot at an end thereof remote from the gripping member;

a connecting mechanism which connects the handle to the valve spool, whereby movement of the handle about the pivot causes lengthwise movement of the valve spool relative to the valve housing; and means for applying a return force to the handle when the handle is in an operative position, which return force varies in proportion to the pressure of the pressure fluid within the valve chamber for as long as the handle is in an operative position, which pressure actuates the device, whereby the return force varies in proportion to the operating pressure supplied to the device, and the means for applying a return force ceases to apply the return force when the handle returns to a neutral position at which pressure to the device is maintained.

2. The valve control system of claim 1, wherein the means for applying a return force includes:

a response piston disposed in the valve housing for engagement with the valve spool;

a pair of variable volume response piston chambers within the valve housing on opposite sides of the response piston; and passages establishing communication between the response piston chambers and associated chambers of the device effective to operate the device in opposite directions.

3. The valve control system of claim 2, wherein the pressure fluid-activated device comprises a two-way hydraulic cylinder, and the passages establish communication between the response piston chambers and opposite sides of a piston head of the two-way hydraulic cylinder.

4. The valve control system of claim 1, wherein the connecting mechanism comprises a link and means for pivotally connecting the link at opposite end portions thereof to the valve spool and to the associated end portion of the handle at a location offset from the pivot.

5. The valve control system of claim 1, wherein the valve housing includes a pressure port for admitting pressurized hydraulic fluid to the valve chamber, an exhaust port for hydraulic fluid, and a load port for admitting hydraulic fluid to the pressure-fluid actuated device, wherein the valve spool isolates the pressure port from the exhaust port and load port when the handle is in the neutral position.

6. A valve control system for controlling operation of a pressure fluid-actuated device, comprising:

a valve housing having a sealed valve chamber therein, the valve chamber including a first bearing, a load port in communication with the valve chamber for conducting pressure fluid to the device, an exhaust port in communication with the valve chamber for relieving pressure within the valve chamber, the exhaust and load ports being disposed on opposite sides of the first bearing, a second bearing spaced from the first bearing, and a pressure port in communication with the valve chamber for supplying pressurized fluid to the valve chamber, the pressure and load ports being disposed on opposite sides of the second bearing, and further having a sealed response piston chamber isolated from the valve chamber and having a feedback port which provides communication between the load port and response piston chamber;

a valve spool slidably disposed for lengthwise movement within the valve chamber and response piston chamber, the valve spool having a valve surface disposed for sliding, sealing engagement with the first and second bearings of the valve chamber between a load position in which the pressure port and load port are in communication with each other, an exhaust position in which the load port and the exhaust port are in communication with each other, and a neutral position in which the load port is isolated from both of the pressure and exhaust ports and the pressure port is isolated from the exhaust port, and an exposed end portion that extends out of the valve housing, a movable handle;

a connecting mechanism which connects the handle to the exposed end portion of the valve spool, whereby movement of the handle causes lengthwise movement of the valve spool relative to the valve housing; and a response piston mounted on the outside of the valve spool within the response piston chamber for sliding movement relative to the valve spool and valve housing, so that movement of the valve surface to the load position in response to movement of the handle causes fluid from the pressure port to flow to the load port and through the feedback port to the response piston chamber, whereby the response piston exerts a force against the valve spool which urges the valve spool towards the neutral position, which force is transmitted to the handle by the connecting mechanism.

7. The valve control system of claim 6, wherein the valve spool further comprises a shoulder disposed in the response piston chamber, so that the response piston engages the shoulder on the valve spool when it urges the valve spool towards the neutral position.

8. The valve control system of claim 7, wherein the valve surface comprises an enlarged diameter cylinder on the valve spool, and the bearings comprise a pair of annular lands spaced in the lengthwise direction of the valve chamber by a distance such that the valve surface cylinder contacts both lands when the valve is in the neutral position, and the load port opens onto the valve chamber at a position between the annular lands.

9. The valve control system of claim 7, wherein the valve housing further comprises a stop disposed in the response piston chamber at which the response piston becomes clamped between the valve spool shoulder and the stop, thereby limiting movement of the valve spool and handle to an endmost position.

10. The valve control system of claim 6, wherein the valve surface comprises the outer surface of the valve spool at either end of an annular recess in the valve spool, and the bearings comprise a pair of annular lands spaced in the lengthwise direction of the valve spool by a distance such that the annular recess bridges both lands when the valve is in the neutral position, and the load port opens onto the valve chamber at a position between the annular lands.

11. The valve control system of claim 6, wherein the movable handle comprises an elongated rod having a gripping member at one end thereof and a pivot at an end thereof remote from the gripping member.

12. A valve control system for controlling operation of a pressure fluid-actuated device, comprising:

a valve housing having a first sealed valve chamber therein, the first valve chamber including a first bearing, a first load port in communication with the first valve chamber for conducting pressure fluid to the device, a first exhaust port in communication with the first valve chamber for relieving pressure within the first valve chamber, the first exhaust and first load ports being disposed on opposite sides of the first bearing, a second bearing spaced from the first bearing, and a pressure port in communication with the first valve chamber for supplying pressurized fluid to the first valve chamber, the pressure and first load ports being disposed on opposite sides of the second bearing, a second sealed valve chamber therein, the second valve chamber including a third bearing, a second load port in communication with the second valve chamber for conducting pressure fluid to the device, a second exhaust port in communication with the second valve chamber for relieving pressure within the second valve chamber, the second exhaust and second load ports being disposed on opposite sides of the third bearing, and a fourth bearing spaced from the third bearing, the pressure port being in communication with the second valve chamber for supplying pressurized fluid to the second valve chamber, the pressure and second load ports being disposed on opposite sides of the fourth bearing, and further having a sealed response piston chamber isolated from the first and second valve chambers and having a first feedback port which provides communication between the first load port and one end of the response piston chamber, and a second feedback port which provides communication between the second load port and the other end of the response piston chamber, the feedback ports being located on opposite sides of the response piston;

a valve spool slidably disposed for lengthwise movement within the valve chambers and response piston chamber, the valve spool having a first valve surface disposed for sliding, sealing engagement with the first and second bearings of the first valve chamber between a first load position in which the pressure port and first load port are in communication with each other, a first exhaust position in which the first load port and the first exhaust port are in communication with each other, and a neutral position in which the first load port is isolated from both of the pressure and first exhaust ports and the pressure port is isolated from the first exhaust port, a second valve surface disposed for sliding, sealing engagement with the third and fourth bearings of the second valve chamber between a second load position in which the pressure port and second load port are in communication with each other, a second exhaust position in which the second load port and the second exhaust port are in communication with each other, and a neutral position in which the second load port is isolated from both of the pressure and second exhaust ports and the pressure port is isolated from the second exhaust port, and an exposed end portion that extends out of the valve housing, a movable handle;

a connecting mechanism which connects the handle to the exposed end portion of the valve spool whereby movement of the handle causes lengthwise movement of the valve spool relative to the valve housing; and a response piston mounted on the outside of the valve spool within the response piston chamber for sliding movement relative to the valve spool and valve housing, so that movement of the first valve surface to the first load position in response to movement of the handle causes fluid from the pressure port to flow to the first load port and through the first feedback port to the response piston chamber, whereby the response piston exerts a force against the valve spool which urges the valve spool towards the neutral position, which force is transmitted to the handle by the connecting mechanism, and so that movement of the second valve surface to the second load position in response to movement of the handle causes fluid from the pressure port to flow to the second load port and through the second feedback port to the response piston chamber, whereby the response piston exerts a force against the valve spool which urges the valve spool towards the neutral position, which force is transmitted to the handle by the connecting mechanism.

13. The valve control system of claim 12, wherein the valve chamber and valve spool are configured so that, when the first valve surface is in the first load position, the second valve surface is in the second exhaust position, and when the second valve surface is in the second load position, the first valve surface is in the first exhaust position.

14. The valve control system of claim 12, wherein the movable handle comprises an elongated rod having a gripping member at one end thereof and a pivot at an end thereof remote from the gripping member.

15. A valve control system for controlling operation of a pressure fluid-actuated device, comprising:

a valve housing having a first sealed valve chamber therein, the first valve chamber including a first bearing, a first load port in communication with the first valve chamber for conducting pressure fluid to the device, a first exhaust port in communication with the first valve chamber for relieving pressure within the first valve chamber, the first exhaust and first load ports being disposed on opposite sides of the first bearing, a second bearing spaced from the first bearing, and a first pressure port in communication with the first valve chamber for supplying pressurized fluid to the first valve chamber, the first pressure and first load ports being disposed on opposite sides of the second bearing, a second sealed valve chamber therein, the second valve chamber including a third bearing, a second load port in communication with the second valve chamber for conducting pressure fluid to the device, a second exhaust port in communication with the second valve chamber for relieving pressure within the second valve chamber, the second exhaust and second load ports being disposed on opposite sides of the third bearing, a fourth bearing spaced from the third bearing, and a second pressure port in communication with the second valve chamber for supplying pressurized fluid to the second valve chamber, the second pressure and second load ports being disposed on opposite sides of the fourth bearing, and further having first and second sealed response piston chambers isolated from the first and second valve chambers and having a first feedback port which provides communication between the first load port and the first response piston chamber, and a second feedback port which provides communication between the second load port and the second response piston chamber;

first and second valve spools slidably disposed for lengthwise movement within the first and second valve chambers, respectively, the first valve spool having a first vale surface disposed for sliding, sealing engagement with the first and second bearings of the first valve chamber between a first load position in which the first pressure port and first load port are in communication with each other, a first exhaust position in which the first load port and the first exhaust port are in communication with each other, and a neutral position in which the first load port is isolated from both of the first pressure and first exhaust ports and the first pressure port is isolated from the first exhaust port, and a first exposed end portion that extends out of the valve housing, the second valve spool having a second valve surface disposed for sliding, sealing engagement with the third and fourth bearings of the second valve chamber between a second load position in which the second pressure port and second load port are in communication with each other, a second exhaust position in which the second load port and the second exhaust port are in communication with each other, and a neutral position in which the second load port is isolated from both of the second pressure and second exhaust ports and the second pressure port is isolated from the second exhaust port, and a second exposed end portion that extends out of the valve housing, a movable handle;

a connecting mechanism which connects the handle to the exposed end portions of the valve spools, whereby movement of the handle causes lengthwise movement of the valve spools relative to the valve housing;

a first response piston mounted within the first response piston chamber for sliding movement relative to the first valve spool and valve housing, so that movement of the first valve surface to the first load position in response to movement of the handle causes fluid from the first pressure port to flow to the first load port and through the first feedback port to the first response piston chamber, whereby the first response piston exerts a force against the first valve spool which urges the first valve spool towards the neutral position, which force is transmitted to the handle by the connecting mechanism; and a second response piston mounted within the second response piston chamber for sliding movement relative to the second valve spool and valve housing, so that movement of the second valve surface to the second load position in response to movement of the handle causes fluid from the second pressure port to flow to the second load port and through the second feedback port to the second response piston chamber, whereby the second response piston exerts a force against the second valve spool which urges the second valve spool towards the neutral position, which force is transmitted to the handle by the connecting mechanism.

16. The valve control system of claim 15, wherein the valve chambers and valve spools are configured so that, when the first valve surface is in the first load position, the second valve surface is in the second exhaust position, and when the second valve surface is in the second load position, the first valve surface is in the first exhaust position.

17. The valve control system of claim 16, wherein said handle further includes a pin for pivotally mounting an end portion of the handle to the housing, and said connecting mechanism includes a first link having means for pivotally connecting said first link to said end portion of said handle at a location offset from said pin and to said first valve spool, and a second link having means for pivotally connecting said second link to said end portion of said handle at a location offset from said pin and on the opposite side thereof from said first link, and to said second valve spool.

18. The valve control system of claim 15, wherein the first and second pressure ports comprise opposite side openings of a common pressure port, and the first and second exhaust ports comprise opposite side openings of a common exhaust port.

19. A pressure fluid-actuated device, comprising a movable arm capable of moving a load, a hydraulic cylinder that operates the arm, and a valve control system for controlling operation of the hydraulic cylinder, including:

a valve housing having a sealed valve chamber therein;

a valve spool slidably disposed for lengthwise movement within the valve chamber, the valve spool having a valve member for selectively admitting a pressure fluid through passages in the valve housing;

a movable handle;

a connecting mechanism which connects the handle to the valve spool, whereby movement of the handle causes length wise movement of the valve spool relative to the valve housing; and means for applying a return force to the handle when the handle is in an operative position, which return force varies in proportion to the operating pressure of the pressure fluid supplied to the hydraulic cylinder for actuating the arm, whereby the return force varies in proportion to the operating pressure, and the means for applying a return force ceases to apply the return force when the handle returns to a neutral position, at which pressure to the hydraulic cylinder is maintained, wherein the return force varies in proportion to the operating pressure for as long as the handle is in an operative position, and the valve housing includes a pressure port for admitting pressurized hydraulic fluid to the valve chamber, an exhaust port for hydraulic fluid, and a load port for admitting hydraulic fluid to the pressure-fluid actuated device, wherein the valve spool isolates the pressure port from the exhaust port and load port when the handle is in the neutral position.

20. The device of claim 19, wherein the hydraulic cylinder is a two-way hydraulic cylinder, and the means for applying a return force includes a response piston disposed in the valve housing for engagement with the valve spool, a pair of variable volume response piston chambers within the valve housing on opposite sides of the response piston, and passages establishing communication between the response piston chambers and opposite sides of a piston head of the two-way hydraulic cylinder.

21. The device of claim 20, wherein the surface area of the response piston against which hydraulic fluid acts is less than the surface area of the piston head against which the hydraulic fluid acts.

22. The device of claim 19, wherein the movable arm further comprises an excavator arm.

* * * * *